US006699138B1

(12) United States Patent
Lin

(10) Patent No.: US 6,699,138 B1
(45) Date of Patent: Mar. 2, 2004

(54) GOLF SWING INDICATION DEVICE

(76) Inventor: Teh-Cheng Lin, 752 Pradera Way, San Ramon, CA (US) 94583

( * ) Notice: Subject to any disclaimer, the term of this patent is extended or adjusted under 35 U.S.C. 154(b) by 5 days.

(21) Appl. No.: 10/237,854

(22) Filed: Sep. 9, 2002

Related U.S. Application Data

(63) Continuation-in-part of application No. 09/736,556, filed on Dec. 13, 2000, now abandoned.

(51) Int. Cl.[7] ..... A63B 57/00; A63B 69/36
(52) U.S. Cl. ..... 473/221; 473/219
(58) Field of Search ..... 473/219–224, 473/226, 231, 234, 453, 461

(56) References Cited

U.S. PATENT DOCUMENTS

| | | | | | |
|---|---|---|---|---|---|
| 3,753,564 | A | * | 8/1973 | Brandell | 473/220 |
| 4,027,886 | A | | 6/1977 | Katsube | 273/186 |
| 4,560,166 | A | * | 12/1985 | Emerson | 473/209 |
| 4,789,160 | A | * | 12/1988 | Dollar et al. | 473/223 |
| 4,819,942 | A | * | 4/1989 | Lee et al. | 473/220 |
| 5,221,088 | A | * | 6/1993 | McTeigue et al. | 473/201 |
| 5,300,921 | A | * | 4/1994 | Hoch et al. | 340/573.6 |
| 5,303,925 | A | * | 4/1994 | Rawson | 473/233 |
| 5,558,519 | A | * | 9/1996 | Sabowitz | 434/247 |
| 5,692,965 | A | * | 12/1997 | Nighan et al. | 473/220 |
| 5,776,006 | A | * | 7/1998 | Gruber | 473/256 |
| 5,788,588 | A | * | 8/1998 | Hooker | 473/409 |
| 5,800,278 | A | * | 9/1998 | Varriano | 473/209 |
| 5,826,578 | A | * | 10/1998 | Curchod | 600/595 |
| 5,907,819 | A | * | 5/1999 | Johnson | 702/152 |
| 5,911,635 | A | * | 6/1999 | Ogden | 473/224 |
| 5,941,779 | A | * | 8/1999 | Zeiner-Gundersen | 473/224 |
| 6,413,167 | B1 | * | 7/2002 | Burke | 473/224 |

* cited by examiner

*Primary Examiner*—Gregory Vidovich
*Assistant Examiner*—Mitra Aryanpour
(74) *Attorney, Agent, or Firm*—Donald J. Ersler

(57) ABSTRACT

A golf swing indication device includes a base plate, a rotary tilt switch unit, an indication device, and-a mounting device. The rotary tilt switch unit is pivotally attached to a top of the base plate. The tilt switch is mounted to the rotary base such that the center line of the tilt switch passes through the center line of the pivot point of the rotary tilt switch unit. Preferably, an on-off switch and a battery are mounted to the top of the base plate. The indication device is preferably mounted on a front of the base plate adjacent the blind bore.

The golf swing indication device is set for distance by rotating the rotary tilt switch unit. As the golfer takes a swing, the indication device should not emit light or sound at any point during the swing.

18 Claims, 7 Drawing Sheets

GOLF SWING INDICATION DEVICE

CROSS-REFERENCES TO RELATED APPLICATIONS

This is a continuation-in-part patent application of Ser. No. 09/736,556 filed on Dec. 13, 2000 now abandoned.

BACKGROUND OF THE INVENTION

1. Field of the Invention

The present invention relates generally to golf clubs and more specifically to a golf swing indication device which is attached to a shaft of a golf club to indicate the smoothness of a particular chipping swing.

2. Discussion of the Prior Art

It appears that no device exists to show whether a golfer has a correct chipping swing. A smooth swing is necessary for properly hitting a golf ball with a golf club.

Accordingly, there is a clearly felt need in the art for a golf swing indication device which indicates whether a golfer has made a proper swing for hitting a chip shot with a golf club.

SUMMARY OF THE INVENTION

The present invention provides a golf swing indication device which provides feedback to a golfer about their chipping swing. The golf swing indication device includes a base plate, a rotary tilt switch unit, an indication device, and a mounting device. The rotary tilt switch unit includes a rotary base, a tilt switch, and a dial knob. The rotary base includes a rotary mounting plate, a tilt switch housing, and a shaft. The shaft extends from a bottom of the rotary mounting plate. A wire opening is formed through the rotary base and shaft. The tilt switch housing is formed on a top of the rotary mounting plate. A switch bore is preferably formed through the tilt switch housing which is sized to receive the tilt switch. A center line of the switch bore preferably passes through a center line of the shaft.

A shaft bore is formed through the base plate to receive the shaft. Preferably, a blind bore is formed in a top of the base plate at one end which is sized to rotably receive the rotary base. An on-off switch is preferably mounted to a top of the base plate at the other end. A battery cavity is preferably disposed on the top of the base plate adjacent the on-off switch. The battery cavity retains at least one battery. The indication device is preferably mounted on a front of the base plate, adjacent the blind bore. The indication device may be a light indication device or an sound indication device.

The dial knob is mounted to a top of the rotary base. The dial knob has a pointer line. The periphery of the blind bore is marked with a dial. Preferably, one lead of the tilt switch is connected to one terminal of the battery and the other lead of the tilt switch is connected to one terminal of the indication device. The other terminal of the indication device is connected to one terminal of the on-off switch. The other terminal of the on-off switch is connected to the other terminal of the battery.

The base plate is attached to a shaft of a golf club with the mounting device. The mounting device is preferably a pair of clamp halves. A first clamp half is attached to a bottom of the base plate with any suitable attachment method. A first groove is formed on a bottom of the first clamp half which is sized to receive a golf club shaft. Preferably, at least two threaded holes are formed through the first clamp half. A second groove is formed on a top of a second clamp half which is sized to receive a golf club shaft. At least two clearance holes are formed through the second clamp half. A single thumb screw is threaded into each threaded hole to retain the first and second clamp halves against a golf club shaft.

The golf swing indication device is set for distance by adjusting the dial knob such that the pointer line aligns with an angle on the dial. The greater the distance of the shot, the higher the value of angle that should be selected. The smaller the angle, the more sensitive the tilt switch becomes to being closed. As the golfer takes a swing, the indication device should not emit light or sound at any point during the swing. If the indication device does emit light or sound during the entire swing, it means that the angle should be increased. If the indication device intermittently emits light or sound, the golfer's swing is too jerky or not smooth and consistent.

Accordingly, it is an object of the present invention to provide a golf swing indication device which indicates whether a golfer is making a proper swing for hitting a chip shot with a golf club.

These and additional objects, advantages, features and benefits of the present invention will become apparent from the following specification.

DETAILED DESCRIPTION OF THE PREFERRED EMBODIMENTS

Figure 1:
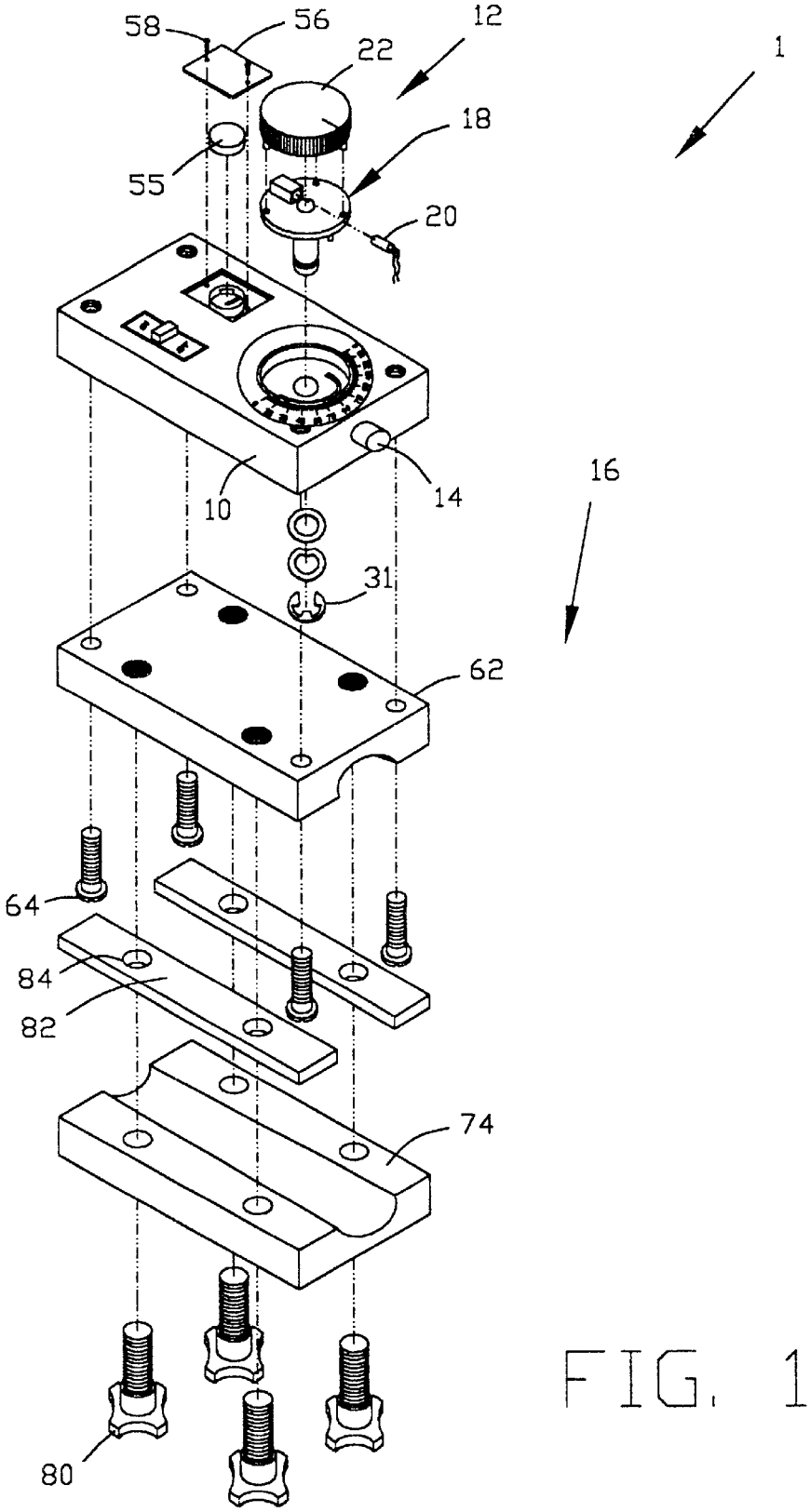
FIG. 1 is an exploded perspective view of a golf swing indication device in accordance with the present invention.
Figure 2:
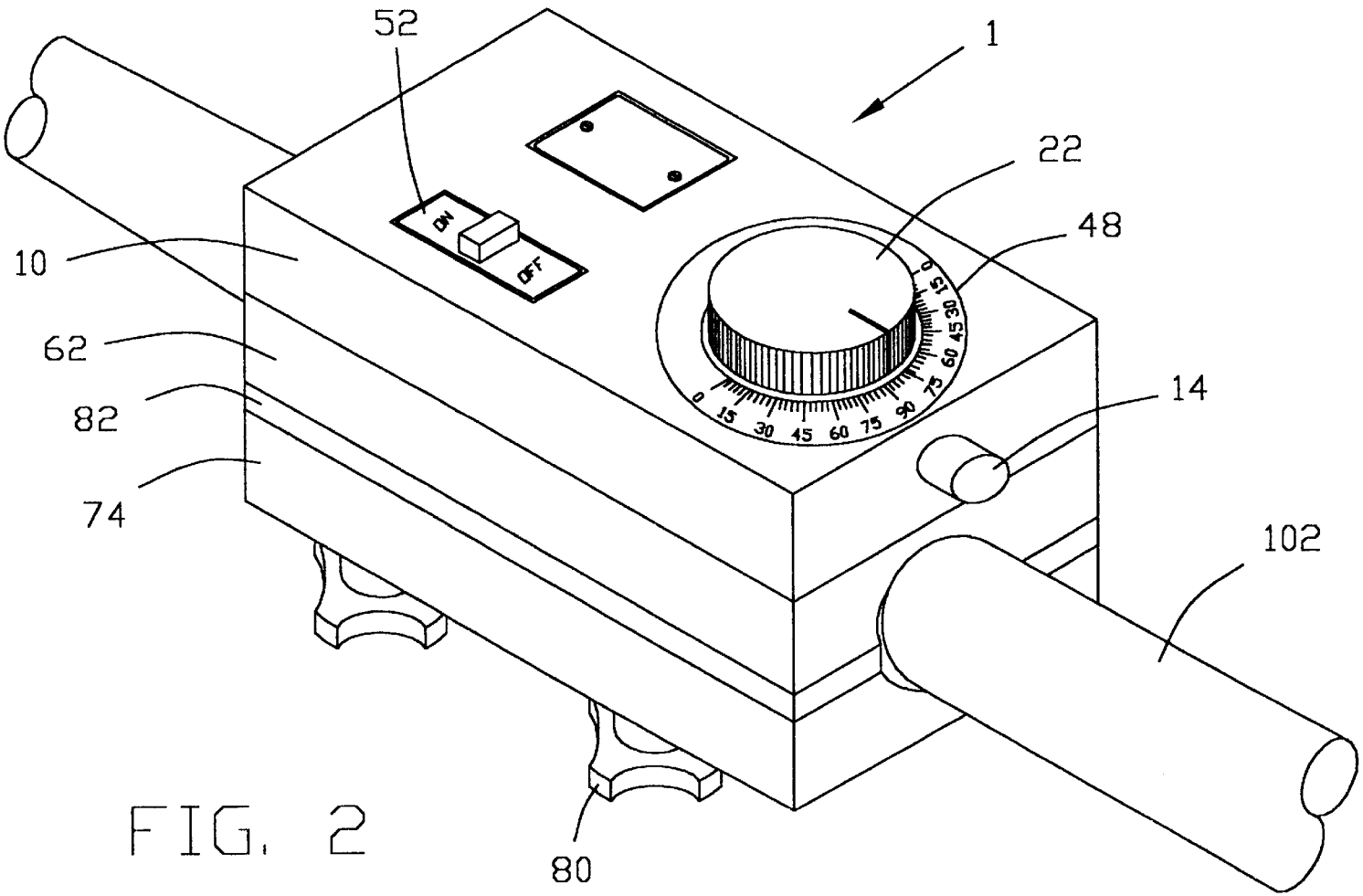
FIG. 2 is an enlarged perspective view of a golf swing indication device mounted to a shaft of a golf club in accordance with the present invention.
Figure 3:
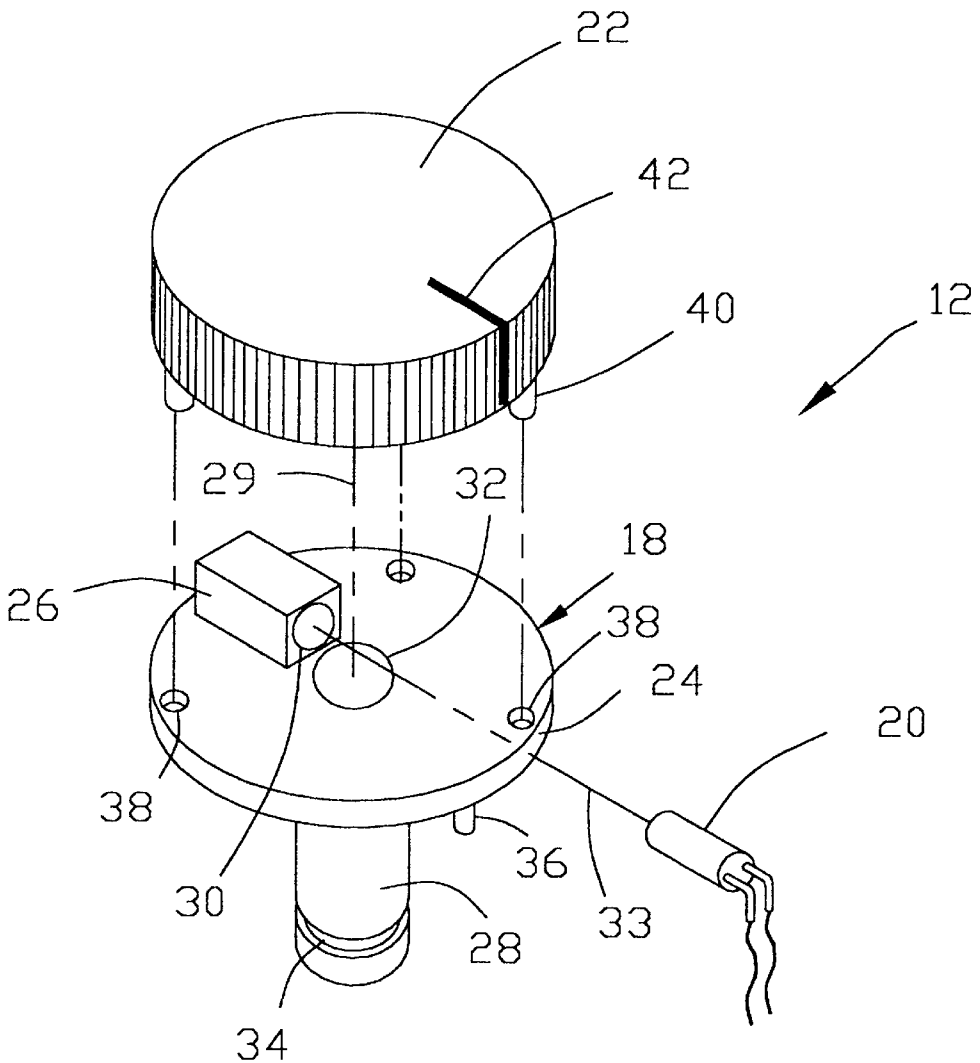
FIG. 3 is an exploded perspective view of a rotary tilt switch unit of a golf swing indication device in accordance with the present invention.

With reference now to the drawings, and particularly to FIG. 1, there is shown an exploded perspective view of a golf swing indication device 1. With reference to FIGS. 2 and 3, the golf swing indication device includes a base plate 10, a rotary tilt switch unit 12, an indication device 14, and a mounting device. The rotary tilt switch unit 12 includes a rotary base 18, a tilt switch 20, and a dial knob 22. The rotary base 18 includes a rotary mounting plate 24, a tilt switch housing 26, and a shaft 28. The tilt switch housing 26 is formed on a top of the rotary mounting plate 24. A switch bore 30 is preferably formed through the tilt switch housing 26 which is sized to receive the tilt switch 20. The tilt switch 20 may be retained in the switch bore 30 with adhesive, a press fit, or any other suitable method. A center line 33 of the switch bore 30 preferably passes through a center line 29 of the shaft 28.

The shaft 28 extends from a bottom of the rotary mounting plate 24. A wire opening 32 is formed through the rotary mounting plate 24 and the length of the shaft 28. The wire opening 32 allows the leads of the tilt switch 20 to pass therethrough. Preferably, a ring groove 34 is formed in a perimeter of the shaft 28 to receive a snap ring 31. Preferably, a limit pin 36 extends from a bottom of the rotary mounting plate 24. Preferably, at least one anti-rotation hole 38 is formed through the rotary mounting plate 24. Preferably, at least one anti-rotation pin 40 extends from a bottom of the dial knob 22. Each anti-rotation hole 38 sized to receive a single anti-rotation pin 40. Each antirotation pin 40 may be retained in a single rotation hole 38 with adhesive, a press fit, or any other suitable method. A pointer line 42 is formed on a top of the dial knob 22. Preferably, if the pointer line 42 were extended across a top of the dial knob it would pass through the shaft center line 29.

Figure 4:
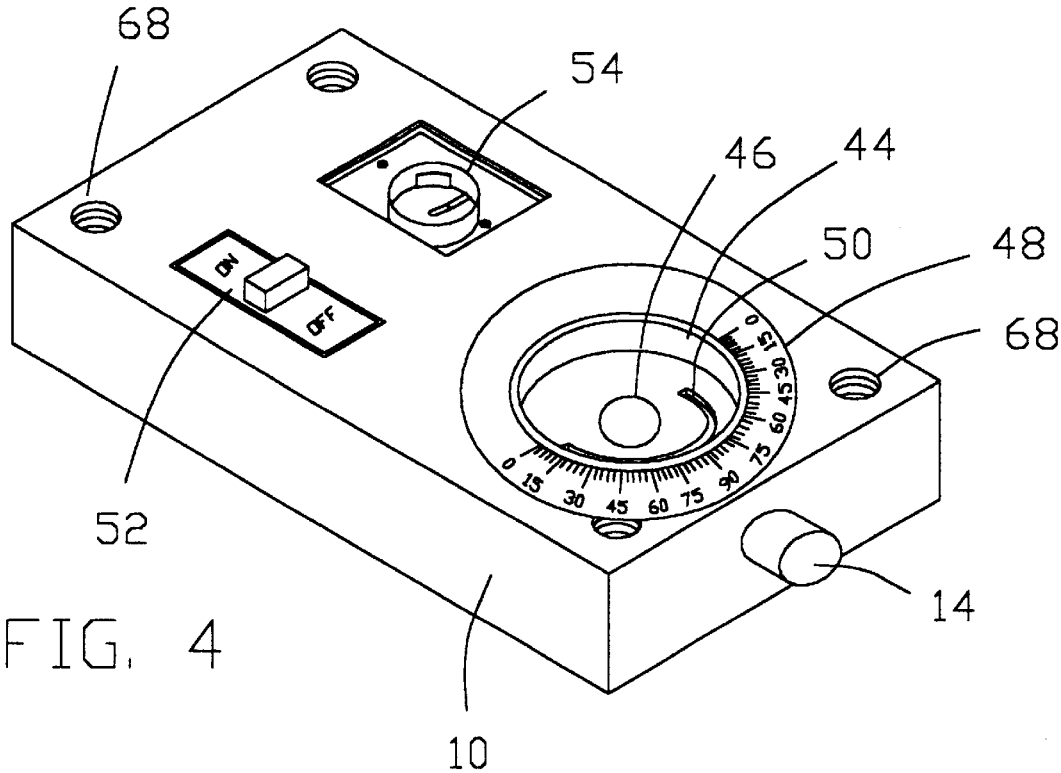
FIG. 4 is a top perspective view of a base plate of a golf swing indication device in accordance with the present invention.

With reference to FIG. 4, a shaft bore 46 is formed through the base plate 10. The shaft bore 46 is sized to rotatably receive the shaft 28. Preferably, a blind bore 44 is formed in a top of the base plate 10 at one end which is sized to rotatably receive the rotary base 18. The shaft bore 46 is concentric with the blind bore 44. The periphery of the blind bore 44 is marked with a dial 48. The dial 48 is preferably gradated into two half scales which each have an angular range from 0–90 degrees. A rotary limiting slot 50 is preferably formed in a bottom of the blind bore 44, concentric with the blind bore 44. The rotary limiting slot 50 is sized and located to slidably receive the limit pin 36. The limit pin 36 prevents the dial knob 22 from being rotated pass the angular limits of the dial 48. The shaft 28 is inserted into the shaft bore 46 and rotatably retained relative to the base plate 10 by attaching the snap ring 31 to the ring groove 34. The pointer line 42 is capable of pointing to one of the angle gradations on the dial 48.

Figure 5:
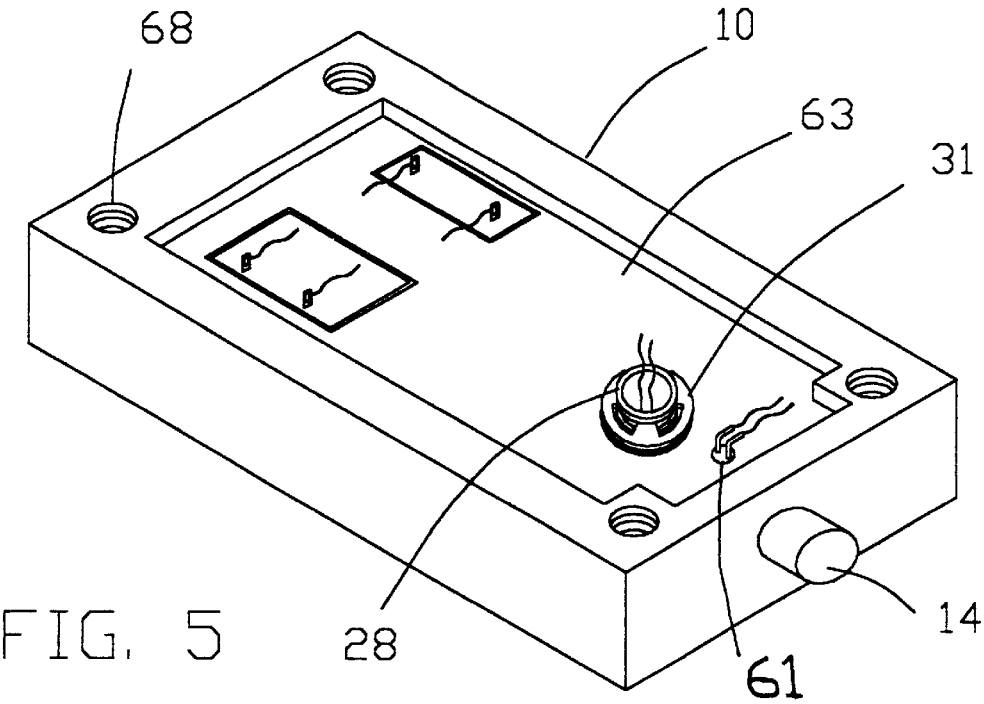
FIG. 5 is a bottom perspective view of a base plate of a golf swing indication device in accordance with the present invention.

An on-off switch 52 is preferably mounted to a top of the base plate 10 at the other end thereof. A battery cavity 54 is preferably formed in the top of the base plate 10 adjacent the on-off switch 52. The battery cavity 54 retains at least one battery 55. A battery plate 56 is removably attached to the base plate 10. A pair of screws 58 may be used to retain the battery plate 56 relative to the base plate 10, but other removable retention methods may also be used. With reference to FIG. 5, the indication device 14 could be a light emitting device or a sound emitting device. The light emitting device may be an LED, incandescent bulb, or any other suitable light emitting device. The sound emitting device may be an audio transducer or any other sound emitting device. It is preferable that the sound emitting device make the sound of a "beep" when "turned-on." A hole 61 is formed in the base for electrical leads of the indication device 14.

Preferably, a recessed area 63 is formed on a bottom of the base plate 10 to provide clearance for running wires. Preferably, one lead of the tilt switch 20 is connected to one terminal of the battery 55 and the other lead of the tilt switch 20 is connected to one terminal of the indication device 14. The other terminal of the indication device 14 is connected to one terminal of the on-off switch 52. The other terminal of the on-off switch 52 is connected to the other terminal of the battery 55. Other wiring schemes may also be used. When the on-off switch 52 is in the on-position, current flows from one terminal of the battery, through the on-off switch 52, and one terminal the tilt switch 20. If the tilt switch 20 is closed, current passes through the tilt switch 20 and the indication device to the other terminal of the battery which enables the indication device 14 to emit light or sound.

Figure 6:
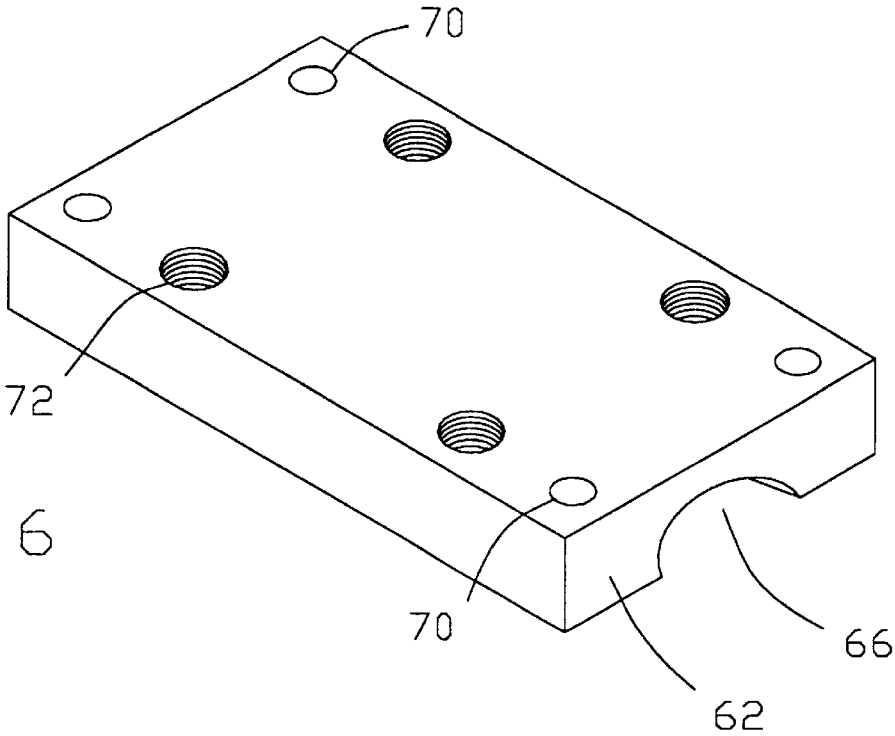
FIG. 6 is a perspective view of a first clamp half of a golf swing indication device in accordance with the present invention.
Figure 7:
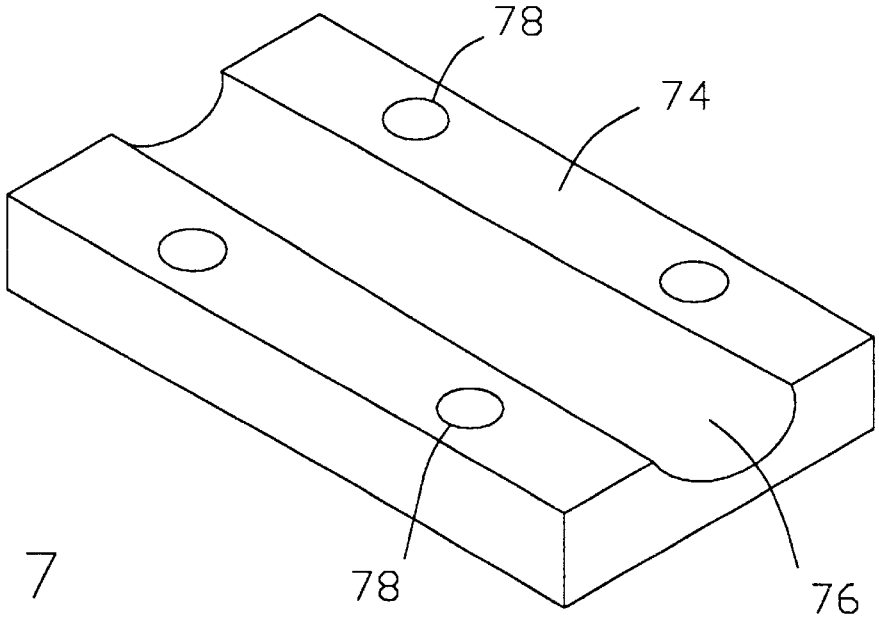
FIG. 7 is a perspective view of a second clamp half of a golf swing indication device in accordance with the present invention.
Figure 8:
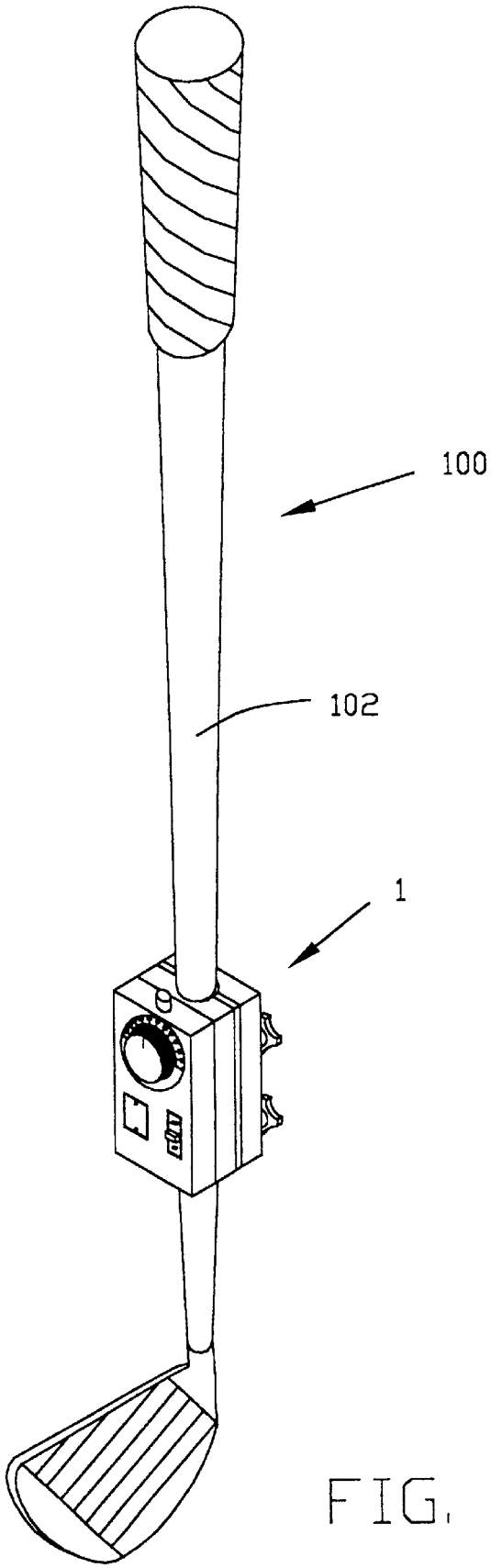
FIG. 8 is a perspective view of a golf swing indication device mounted to a shaft of a golf club in accordance with the present invention.

With reference to FIGS. 6–8, the mounting device is preferably a pair of clamp halves 16. A first clamp half 62 is attached to a bottom of the base plate 10 with screws 64 or any other suitable fastening device or method. If screws 64 are used to fasten the first clamp half 62 to the base plate 10, threaded holes 68 are formed through the base plate 10 and clearance holes 70 are formed through the first clamp half 62. A first groove 66 is formed on a bottom of the first clamp half 62 which is sized to receive a shaft 102 of a golf club 100. At least two threaded holes 72 are preferably formed through the first clamp half 62.

A second groove 76 is formed on a top of a second clamp half 74 which is sized to receive the shaft 102. At least two clearance holes 78 are formed through the second clamp half 74. A single thumb screw 80 is inserted through each clearance hole 78 and threaded into each threaded hole 72 to retain the first and second clamp halves against the shaft 102. Preferably, a pair of gaskets 82 are placed between the first and second clamp halves to prevent the shaft 102 from being crushed. Clearance holes 84 are formed through the pair of gaskets to provide clearance for the thumb screws 80.

The golf swing indicator device 1 is set for a particular distance by adjusting the dial knob 22 such that the pointer line 42 aligns with the gradated angle on the dial 48. The greater the distance of the chipping shot, the higher the value of angle that should be selected. With reference to FIG. 9, the rotary base 18 is positioned such that the tilt switch 20 is adjacent a 90 degree gradation on the dial 48. The tilt switch 20 includes a first contact 23, a second contact 25, and a conductive ball 21. The tilt switch 20 is normally open. Electrical current does not pass through the first and second contacts. However, when the conductive ball 21 makes electrical contact with both the first and second contacts, electrical current passes through the first and second contacts. The conductive ball 21 is commonly a glob of mercury, a conductively coated ball, or any other conductive device.

Figure 9A:
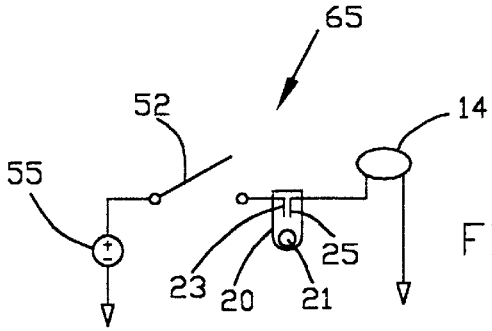
FIG. 9*a* is an electrical schematic of an indication circuit of a golf swing indication device in accordance with the present invention.
Figure 9:
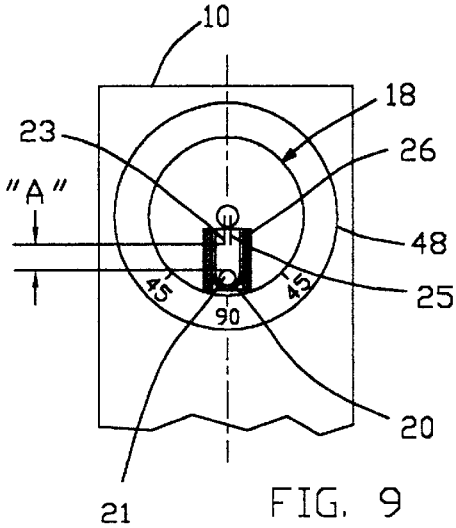
FIG. 9 is a front cutaway view of a tilt switch retained in a rotary base at a position of 90 degrees in a base plate of a golf swing indication device in accordance with the present invention.

FIG. 9*a* shows an electrical schematic of an indication circuit 65. The indication circuit 65 includes the battery 55, the on-off switch 52, the tilt switch 20, and the indication device 14. The battery 55 supplies electrical current to the on-off switch 52. When the on-off switch 52 is closed electrical current is supplied to the first contact 23 of the tilt switch 20. If the golfer makes a jerky swing, the conductive ball 21 will rise and make an electrical connection between the first and second contacts, which will allow the electrical current to be supplied to the indication device 14.

Figure 10:
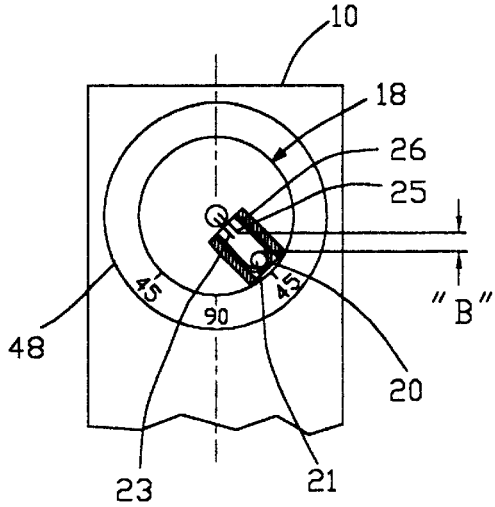
FIG. 10 is a front cutaway view of a tilt switch retained in a rotary base at a position of 45 degrees in a base plate of a golf swing indication device in accordance with the present invention.

The distance between a conductive ball 21 and the first 23 and second 25 contacts is dimension "A." With reference to FIG. 10, the rotary base 18 is positioned such that the tilt switch 20 is adjacent a 45 degree gradation on the dial 48. The distance between the conductive ball 21 and the first and second contacts is dimension "B." Dimension "A" is greater than dimension "B." The smaller the angle, the more sensitive the tilt switch 20 comes to being closed by the conductive ball 21 contacting the first and second contacts.

Figure 11:
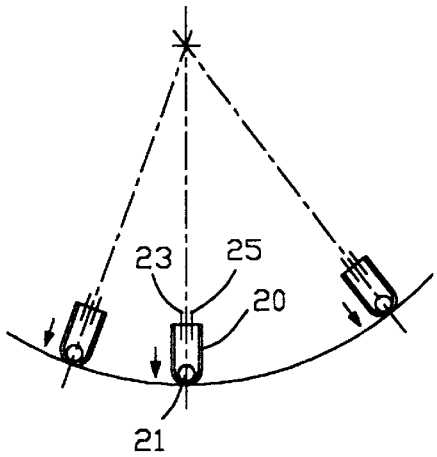
FIG. 11 is a side view of a tilt switch as thereof is being swung of a golf swing indication device in accordance with the present invention.
Figure 12:
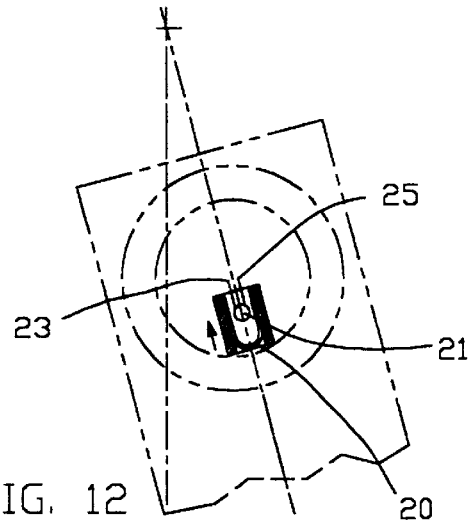
FIG. 12 is a side view of a tilt switch of a golf swing indication device at the instant of a jerk during the swing of a golf club in accordance with the present invention.

With reference to FIG. 11, as the golfer takes a smooth swing, the conductive ball 21 is forced away from the first and second contacts by centripetal force. FIG. 12 shows the conductive ball 21 in contact with the first and second contacts, due to a deceleration of a swing, which overcame the centripetal force. The deceleration in the swing resulted from a jerk during the swing. The indicator device 14 should not emit light or sound at any point during the swing. If the indicator device 14 emits light or sound during the entire swing, it means that the angle should be increased. If the indicator device 14 intermittently emits light or sound, the golfer's swing is too jerky or not smooth and consistent. The golfer must practice until they obtain a smooth and consistent swing.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A golf swing indication device comprising:

a base plate being mounted to a shaft of a golf club;

a rotary tilt switch unit including a tilt switch, said rotary tilt switch unit being pivotally mounted to said base plate, said tilt switch including a first contact, a second contact, and a conductive ball, electrical current flowing through said first and second contacts when said conductive ball makes an electrical connection with said first and second contacts;

an indication device being powered by an electrical power source and connected to said tilt switch, said indication device emitting light or sound when said tilt switch is closed; and said rotary tilt switch unit being rotated according to the length of swing, said tilt switch being open when the golf club is held adjacent to a golf ball, said indication device emitting light or sound if a jerky motion occurs during the swing which causes said conductive ball to make an electrical connection with said first and second contacts.

2. The golf swing indication device of claim 1, further comprising:

a first clamp half being attached to a bottom of said base plate, a first groove being formed in a bottom of said first clamp half to receive a golf club shaft, a second groove being formed in a top of a second clamp half, said second clamp half being attachable to said bottom of said first clamp half with at least two thumb screws.

3. The golf swing indication device of claim 2, further comprising:

a pair of gaskets being inserted between said first and second clamp halves.

4. The golf swing indication device of claim 1, further comprising:

an on-off switch capable of preventing the flow of electrical current to said indication device.

5. The golf swing indication device of claim 1, further comprising:

said power source being a battery retained by said base plate.

6. The golf swing indication device of claim 1, further comprising:

a dial with angle gradations formed on said base plate around the periphery of said rotary tilt switch unit, a pointer line being formed on a top of said rotary tilt switch unit, said pointer line indicating an angle on said dial.

7. The golf swing indication device of claim 1, further comprising:

a rotary limiting slot being formed in said base plate concentric with said dial, a limit pin being formed on a bottom of said rotary tilt switch unit, said rotary limiting slot being sized and located to receive said limit pin, said limit pin preventing said rotary tilt switch unit from being rotated pass the angular limits of said dial.

8. A golf swing indication device comprising:

a base plate being mounted to a shaft of a golf club;

a rotary tilt switch unit including a tilt switch, said rotary tilt switch unit being pivotally mounted to said base plate, said tilt switch including a first contact, a second contact, and a conductive ball, electrical current flowing through said first and second contacts when said conductive ball makes an electrical connection with said first and second contacts;

an indication device being powered by an electrical power source and connected to said tilt switch, said indication device emitting light or sound when said tilt switch is closed;

a dial with angle gradations being formed on said base plate around the periphery of said rotary tilt switch unit, a pointer line being formed on a top of said rotary tilt switch unit, said pointer line indicating the angle on said dial; and said tilt switch unit being rotated according to the length of swing, said tilt switch being open when the golf club is held adjacent a golf ball, said indication device emitting light or sound if a jerky motion occurs during the swing which causes said conductive ball to make an electrical connection with said first and second contacts.

9. The golf swing indication device of claim 8, further comprising:

a first clamp half being attached to a bottom of said base plate, a first groove being formed in a bottom of said first clamp half to receive a golf club shaft, a second groove being formed in a top of a second clamp half, said second clamp half being attachable to said bottom of said first clamp half with at least two thumb screws.

10. The golf swing indication device of claim 9, further comprising:

a pair of gaskets being inserted between said first and second clamp halves.

11. The golf swing indication device of claim 8, further comprising:

an on-off switch capable of preventing the flow of electrical current to said indication device.

12. The golf swing indication device of claim 8, further comprising:

said power source being a battery retained by said base plate.

13. The golf swing indication device of claim 8, further comprising:

a rotary limiting slot being formed in said base plate concentric with said dial, a limit pin being formed on a bottom of said rotary tilt switch unit, said rotary limiting slot being sized and located to receive said limit pin, said limit pin preventing said rotary tilt switch unit from being rotated pass the angular limits of said dial.

14. A golf swing indication device comprising:

a base plate being mounted to a shaft of a golf club;

a rotary tilt switch unit including a tilt switch, said rotary tilt switch unit being pivotally mounted to said base plate, said tilt switch including a first contact, a second contact, and a conductive ball, electrical current flowing through said first and second contacts when said conductive ball makes an electrical connection with said first and second contacts;

an indication device being powered by an electrical power source and connected to said tilt switch, said indication device emitting light or sound when said tilt switch is closed;

a dial with angle gradations being formed on said base plate around the periphery of said rotary tilt switch unit, a pointer line being formed on a top of said rotary tilt switch unit, said pointer line indicating the angle on said dial;

a first clamp half being attached to a bottom of said base plate, a first groove being formed in a bottom of said first clamp half to receive a golf club shaft, a second groove being formed in a top of a second clamp half, said second clamp half being attachable to said bottom of said first clamp half with at least two thumb screws; and said tilt switch unit being rotated according to the length of swing, said tilt switch being open when the golf club is held adjacent a golf ball, said indication device emitting light or sound if a jerky motion occurs during the swing which causes said conductive ball to make an electrical connection with said first and second contacts.

15. The golf swing indication device of claim 14, further comprising:

a pair of gaskets being inserted between said first and second clamp halves.

16. The golf swing indication device of claim 14, further comprising: an on-off switch capable of preventing the flow of electrical current to said indication device.

17. The golf swing indication device of claim 14, further comprising:

said power source being a battery retained by said base plate.

18. The golf swing indication device of claim 14, further comprising:

a rotary limiting slot being formed in said base plate concentric with said dial, a limit pin being formed on a bottom of said rotary tilt switch unit, said rotary limiting slot being sized and located to receive said limit pin, said limit pin preventing said rotary tilt switch unit from being rotated pass the angular limits of said dial.

* * * * *